US007229394B1

(12) United States Patent
Tyree

(10) Patent No.: US 7,229,394 B1
(45) Date of Patent: Jun. 12, 2007

(54) WORKOUT EQUIPMENT

(76) Inventor: Timothy Tyree, 16011 N. 49th St., Scottsdale, AZ (US) 95254

( * ) Notice: Subject to any disclaimer, the term of this patent is extended or adjusted under 35 U.S.C. 154(b) by 494 days.

(21) Appl. No.: 10/211,553

(22) Filed: Aug. 5, 2002

(51) Int. Cl.
*A63B 21/00* (2006.01)

(52) U.S. Cl. ..... 482/137; 482/100; 482/142

(58) Field of Classification Search ..... 482/904, 482/907, 908, 137, 97, 100–103, 140, 141, 482/148, 145, 142, 130, 95, 133–136
See application file for complete search history.

(56) References Cited

U.S. PATENT DOCUMENTS

| | | | | |
|---|---|---|---|---|
| 4,468,026 | A | | 8/1984 | Roark |
| 4,575,077 | A | | 3/1986 | Osborne et al. |
| 4,627,619 | A | * | 12/1986 | Rockwell et al. |
| 4,725,056 | A | | 2/1988 | Rehrl et al. |
| 5,058,884 | A | | 10/1991 | Fuller, Sr. |
| 5,094,450 | A | | 3/1992 | Stearns |
| 5,158,520 | A | | 10/1992 | Lemke et al. |
| 5,300,005 | A | * | 4/1994 | Wang ..... 482/142 |
| 5,334,120 | A | | 8/1994 | Rasmussen |
| 5,387,171 | A | * | 2/1995 | Casey et al. ..... 482/130 |
| 5,499,962 | A | | 3/1996 | Jones |
| 5,569,133 | A | | 10/1996 | Vittone |
| 5,628,714 | A | | 5/1997 | Philipson |
| 5,634,873 | A | | 6/1997 | Carlstrom |
| 5,656,003 | A | * | 8/1997 | Robinson et al. ..... 482/93 |
| 5,669,860 | A | * | 9/1997 | Reyes ..... 482/97 |
| 5,711,749 | A | | 1/1998 | Miller |
| 5,766,118 | A | | 6/1998 | Conner |
| 6,059,698 | A | | 5/2000 | Mazor |
| 6,059,701 | A | | 5/2000 | George et al. |
| 6,106,444 | A | | 8/2000 | Maingart |
| 6,231,486 | B1 | | 5/2001 | Lee |
| 6,296,594 | B1 | | 10/2001 | Simonson |
| 2004/0209745 | A1 | * | 10/2004 | Riney et al. ..... 482/97 |

* cited by examiner

*Primary Examiner*—Jerome Donnelly
(74) *Attorney, Agent, or Firm*—Bacon & Thomas

(57) ABSTRACT

Exercise machines for the leg muscles using separate machines for the biceps femoris and quadriceps and with the biceps femoris machines configured so that the muscle attachment below the knee is the "origin" and the muscle attachment on the upper leg and hip bone is the "insertion".

5 Claims, 6 Drawing Sheets

WORKOUT EQUIPMENT

FIELD OF THE INVENTION

The present invention relates in general to workout or exercise equipment, and in particular to such equipment which can be used for primarily exercising the leg muscles.

BACKGROUND OF THE INVENTION AND PRIOR ART

The need for physical exercise and conditioning is well known, especially in a culture where physical exertion is not emphasized as it once may have been, and where the demand on athletes of all ages to compete at a high level is on the rise. An entire industry has developed for the purpose of affording people the opportunity to exercise so as to maintain health, appearance, and competitiveness. Gyms can be found in almost every city and town in the country. All of them have a variety of machines which one can use in their workouts. Some are quite complicated, and some are designed for special muscle groups. To understand the present invention better, a general review of the muscles of the human body should help.

All of the muscles on the exterior of the human body involve a muscle "belly" with a tendon on each end attaching each end to a respective bone. As the muscles flex and extend, they operate the bones as levers. The tendon that attaches one end of a muscle to a bone and remains fixed during flexion is termed the "origin" of the muscle and the tendon that attaches the other end of the muscle to a second bone and moves that bone during flexion is termed the "insertion" of the muscle.

The most common and easily recognized example of these relationships is the biceps brachii, located on the upper arm and attached at two points at the upper arm and scapula and a single lower point on the lower arm slightly past the elbow. The most common exercise for the biceps brachii is the barbell curl (which can be achieved by a dead weight or a machine). A barbell (dead weight) is lifted off the floor with both arms extended, and with the body fully vertical, the barbell is curled to a position below the chin as the elbows are held at the sides of the body. The "origin" of the biceps brachii in this exercise is the two-point upper attachment (fixed) while the "insertion" is the lower attachment that moves the lower arm in a pivotal motion from full extension to full flexion to the position below the chin.

Another common exercise for the biceps brachii is the chinning exercise. The arms grasp an overhead bar and the body is pulled up until the chin is positioned over the bar at full flexion. In this exercise, the "origin" and "insertion" are the reverse of the barbell curl exercise. The attachment to the lower arm is the "origin" (fixed) while the two-point attachment at the upper arm and scapula becomes the "insertion" and performs the movement of the entire body to the position where the chin is positioned over the bar.

By changing the position of muscle flexion based upon the "origin" and "insertion" of a muscle, the "belly" of the muscle becomes more developed and adaptable in strength and coordination.

One can appreciate the difficulty encountered in developing the human muscles using dead weights. It is time consuming at the minimum. Accordingly, there has been considerable development in the past fifty years of exercise machines using various body supports with pulleys and weights to position a user to isolate and exercise specific muscles in a multitude of varying positions.

The present invention is directed to a novel group of workout equipment and to a method to exercise the upper leg muscles, the biceps femoris, commonly referred to as the hamstrings, and also to the quadriceps. The biceps femoris is an upper leg muscle somewhat analogous to the biceps brachii on the upper arm. In a similar manner, the biceps femoris is attached between two points at the upper leg bone and hip bone and a single lower point on the lower leg slightly past the knee.

There are several exercise machines that are well known in which the attachment of the upper leg bone and hip bone attachment is the "origin" and the lower leg bone attachment is the "insertion". For example, U.S. Pat. No. 5,499,962, discloses a sitting position in which the knees are fixed in front and the heels are imposed on a padded roller on a lever that raises a stack of weights as the biceps femoris is flexed to bring the heels close to the buttocks. U.S. Pat. No. 4,575,077, discloses a bench on which the user lies on his stomach with the knees fixed in front and the heels, again, imposed on a padded roller on a lever that raises a stack of weights as the biceps femoris is flexed to bring the heels close to the buttocks.

Additional examples of machines of this type are the following U.S. Pat. Nos.: 4,468,026; 4,725,056; 5,058,884; 5,094,450; 5,158,520; 5,334,120; 5,569,133; 5,628,714; 5,634,873; 5,711,749; 5,766,118; 6,059,698; 6,059,701; 6,106,444; 6,296,594; and 6,231,486;

None of the known equipment is specifically directed to exercising the upper leg muscles, such as the biceps femoris, and the quadriceps, and to do so in an efficient manner which maximizes muscle performance and development.

The prior art cited above has been cited in an Information Disclosure Statement filed with this application.

In view of the present state of the art, it would be desirable to have equipment available for use in specifically exercising the upper leg muscles, such as the biceps femoris and to provide a technique which one can utilize in using this equipment for efficiently exercising the upper leg muscles.

SUMMARY OF THE INVENTION

It is an object of the present invention to provide equipment and a technique for specifically exercising the upper leg muscles, such as the biceps femoris. The equipment and technique according to the present invention reverses the "origin" and "insertion" of the biceps femoris, for example, by fixing the position of the heel to stabilize the lower leg and have the upper leg bone pull the entire upper body to bring the buttocks close to the heel. This results in the biceps femoris attachment to the lower leg bone being the "origin" and the attachment at the upper leg bone and hip bone being the "insertion".

The muscles of the leg are extremely strong with power lifters having squatted with over 1000 pounds on the shoulders. However, the main muscle mass performing the squat is the quadriceps muscle on the front of the thigh bone. The biceps femoris on the rear of the thigh bone acts mainly as a stabilizing muscle during heavy squatting.

It is a further object of the present invention to employ in the technique use of part of the upper body weight as the resistance that the biceps femoris muscle moves from full extension to full flexion. This is accomplished by using levers and weights to support part of the upper body weight during movement from full extension to full flexion.

It is still a further object of the present invention to provide an exercise machine for the quadriceps muscle on the front of the legs. This machine will enable an elder person or a person beginning an exercise program or a person recovering from a leg injury to perform the squat exercise. It consists of a lever and cable with a stack of weights combined with a pivotable seat on which the user can sit while squatting to a parallel position with the weight stack offsetting a portion of the user's body weight.

It is still a further object of the invention to provide an exercise machine that allows not only for the development of strength but quickness as well.

BRIEF DESCRIPTION OF THE DRAWINGS

Seven figures have been selected to illustrate the present invention in its various aspects.

DETAILED DESCRIPTION OF THE INVENTION IN ITS VARIOUS EMBODIMENTS

Figure 1:
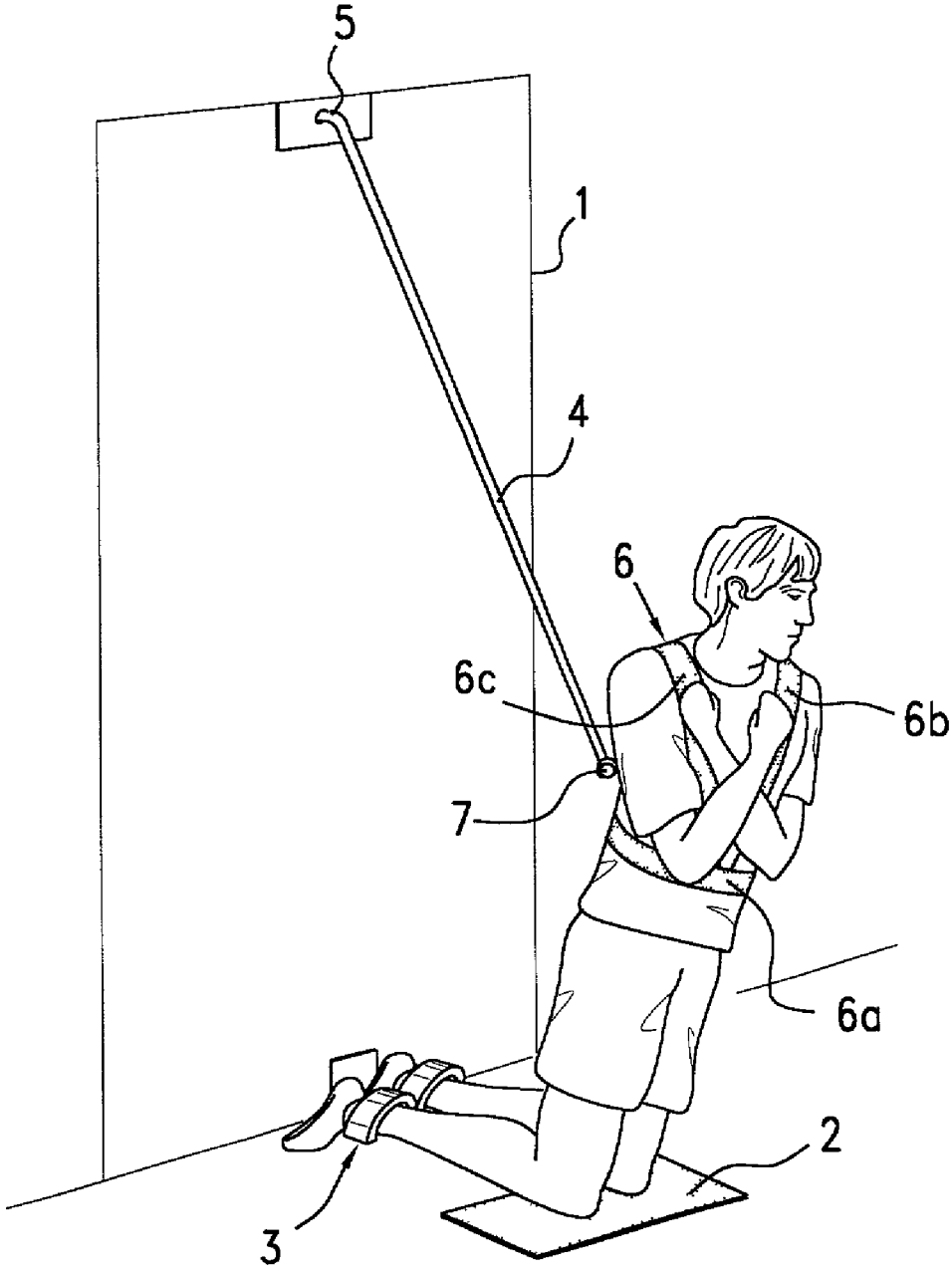
FIG. 1 is the most simple apparatus for exercising the hamstrings with the muscle attachment below the knees functioning as the "origin".

In FIG. 1, a hamstring exercise using the muscle attachment of the biceps femoris below the knees as the "origin" can be performed with a minimum of equipment in a person's home. This exercise requires a door 1, and the equipment includes a knee pad 2, a set of anchor boots 3 with tips to slide under the door, an elastic band 4 with a door clamp 5 and a body harness 6 with a hook 7 for attachment to the elastic band 4.

The harness 6 has as a minimum a torso strap 6*a* and two shoulder straps 6*b* and 6*c*. The shoulder straps 6*b* and 6*c* are connected to the torso strap 6*a* in an overlap fashion or separated from each other. The torso strap 6*a* can be worn at the waist of the user or above. The two shoulder straps 6*b* and 6*c* and the torso strap 6*a* can each be provided with an adjustment capability, such as would result from the use of a typical buckle arrangement. The hook 7 is attached, preferably, to the torso strap 6*a* on the back of the harness.

The user attaches the elastic band 4 to the top of the door 1, by engaging the clamp 5 with the top of the door 1, and to the back of the harness 6, with any conventional clamp-type device, and kneels on the knee pad 2 with the tips of the anchor boots 3 inserted under the door in the position shown. The user then leans forward toward a horizontal position (full extension of the biceps femoris) and, from that position, returns his or her body to the original position by flexing the biceps femoris. The strain on the biceps femoris is reduced by the elastic band 4 assisting the hamstrings.

Figure 3:
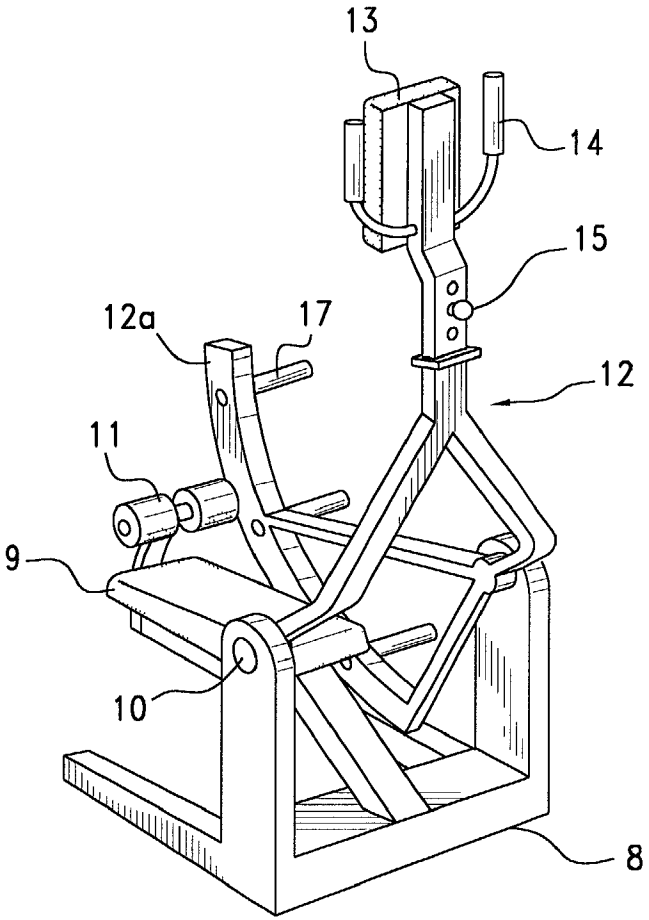
FIG. 3 is a perspective view of the apparatus shown in FIG. 2.
Figure 2:
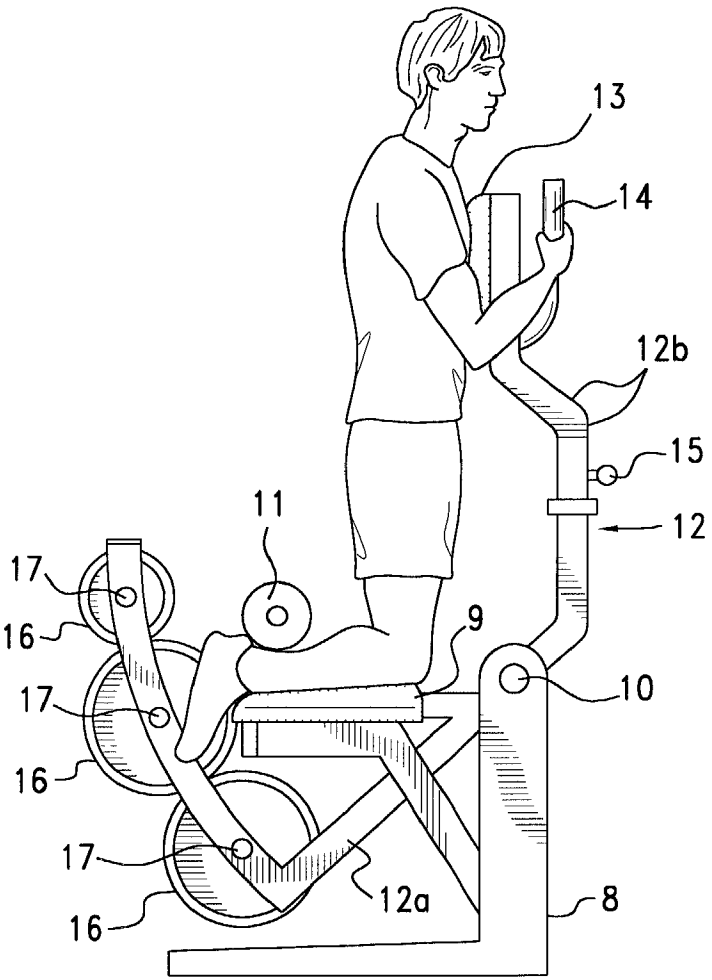
FIG. 2 is a second apparatus for exercising the hamstrings with the muscle attachment below the knees functioning as the "origin" using a pivotable lever with a varying moment arm.

In FIGS. 2 and 3, the hamstring exercise apparatus comprises a stand alone support base with a lever. A generally L-shaped base 8 provides a raised padded knee pad 9, and on substantially the same plane, a pivot 10. The rear of the knee pad has a raised padded roller 11 under which a user can place their ankles. A lever 12 is attached to the pivot and has an upper padded area 13 that can contact a user's chest along with a handle bar 14 on each side. The lever 12 has a lower rear extending portion 12*a* on which different size weights 16 can be placed on horizontally extending pins 17. An upper portion 12*b* is adjustable in height, preferably telescopically, relative to the lower rear extending portion 12*a*, and is fastened in place once adjusted by a fastening means, preferably a set screw or locking pin and slot arrangement 15.

The user adjusts the chest pad 13 to a desired position and kneels on the pad 9 with his ankles secured under the roller 11, which can be a single roller or spaced rollers, one for each ankle, and leans forward toward a horizontal position (full extension of the biceps femoris) and, from that position, returns his body to the original position by flexing the biceps femoris. The strain on the biceps femoris is reduced by the weights on the lever.

Figure 4:
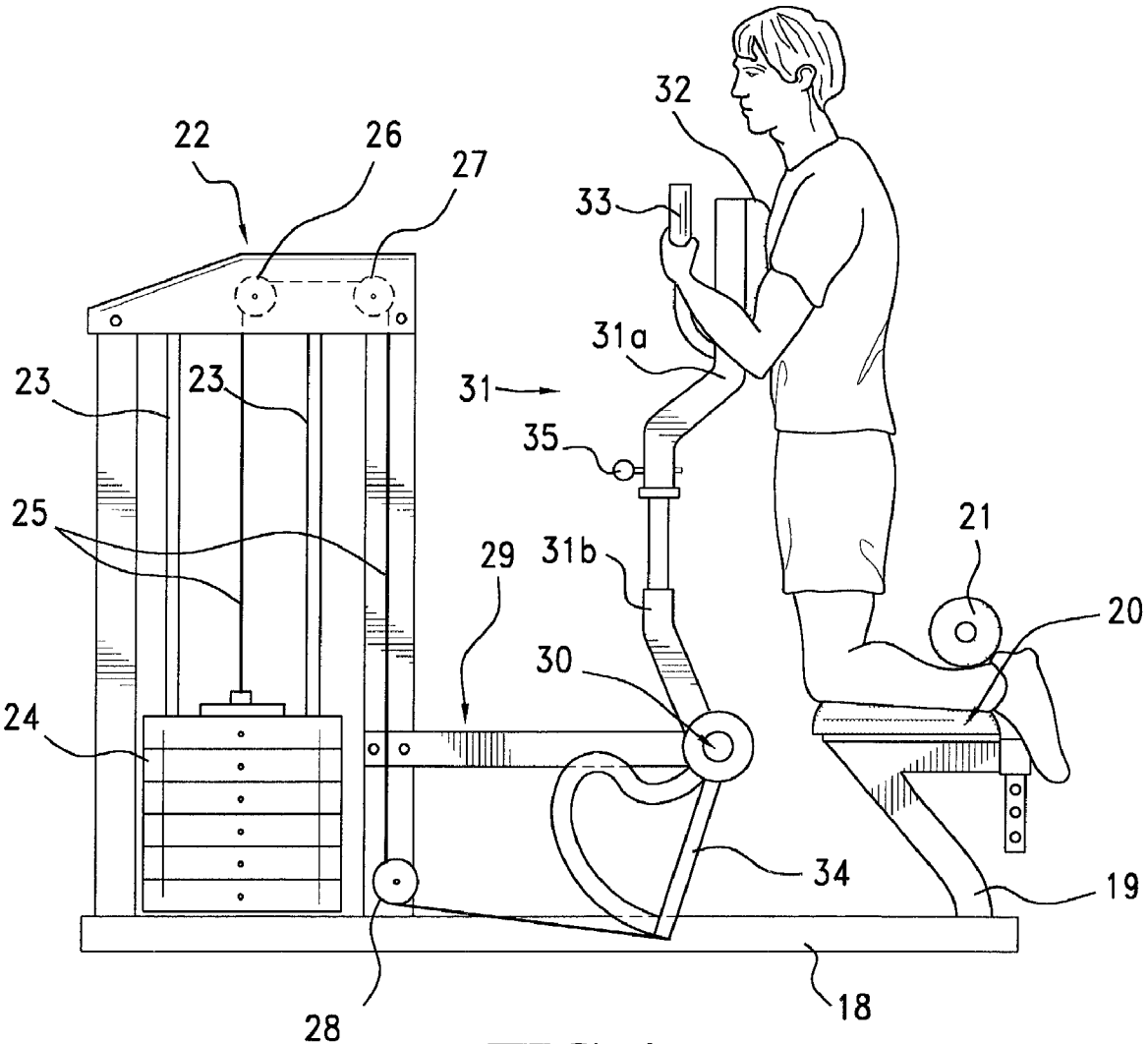
FIG. 4 is a third apparatus for exercising the hamstrings with the muscle attachment below the knees functioning as the "origin" using a pivotable lever attached to a cable to raise and lower a stack of selected weights.

In FIG. 4, the hamstring exercise apparatus comprises a stand alone support base 18 with a lever and cable attached to a weight stack. The support base 18 has a raised portion 19 attached to one end with a padded knee pad 20 and a raised padded roller 21 on the rear portion of the knee pad 20. The roller 21 can be similarly configured to roller 11. The opposite end of the support base 18 has a raised framework 22 with descending guide rods 23 that contain a selectorized weight stack of flat plates 24. A cable 25 is attached to the top of the weight stack over two pulleys 26 and 27 at the top of the framework and down to a pulley 28 at the base of the framework. Extending out from the framework 22 on the same level of the knee pad is a horizontal support 29 for a pivot 30. The pivot supports a lever 31 comprising an upper adjustable portion 31*a* that has an upper padded area 32 that can contact a user's chest along with a handle bar 33 on each side. The lower portion 31*b* of the lever on the other side of the pivot has a curved portion 34 of varying radius with an attachment to the cable 25 as it extends horizontally from pulley 28.

The upper portion 31*a* is adjustable in height similarly to the upper portion 12*b* and is fastened by a set screw or pin and slot arrangement 35, which is similar to the screw or pin and slot arrangement 15.

The user adjusts the chest pad 32 to a desired position and kneels on the pad 20 with his or her ankles secured under the roller 21 and leans forward toward a horizontal position (full extension of the biceps femoris) and, from that position, returns his or her body to the original position by flexing the biceps femoris. The strain on the biceps femoris is reduced by the weights supported on the cable.

Figure 5:
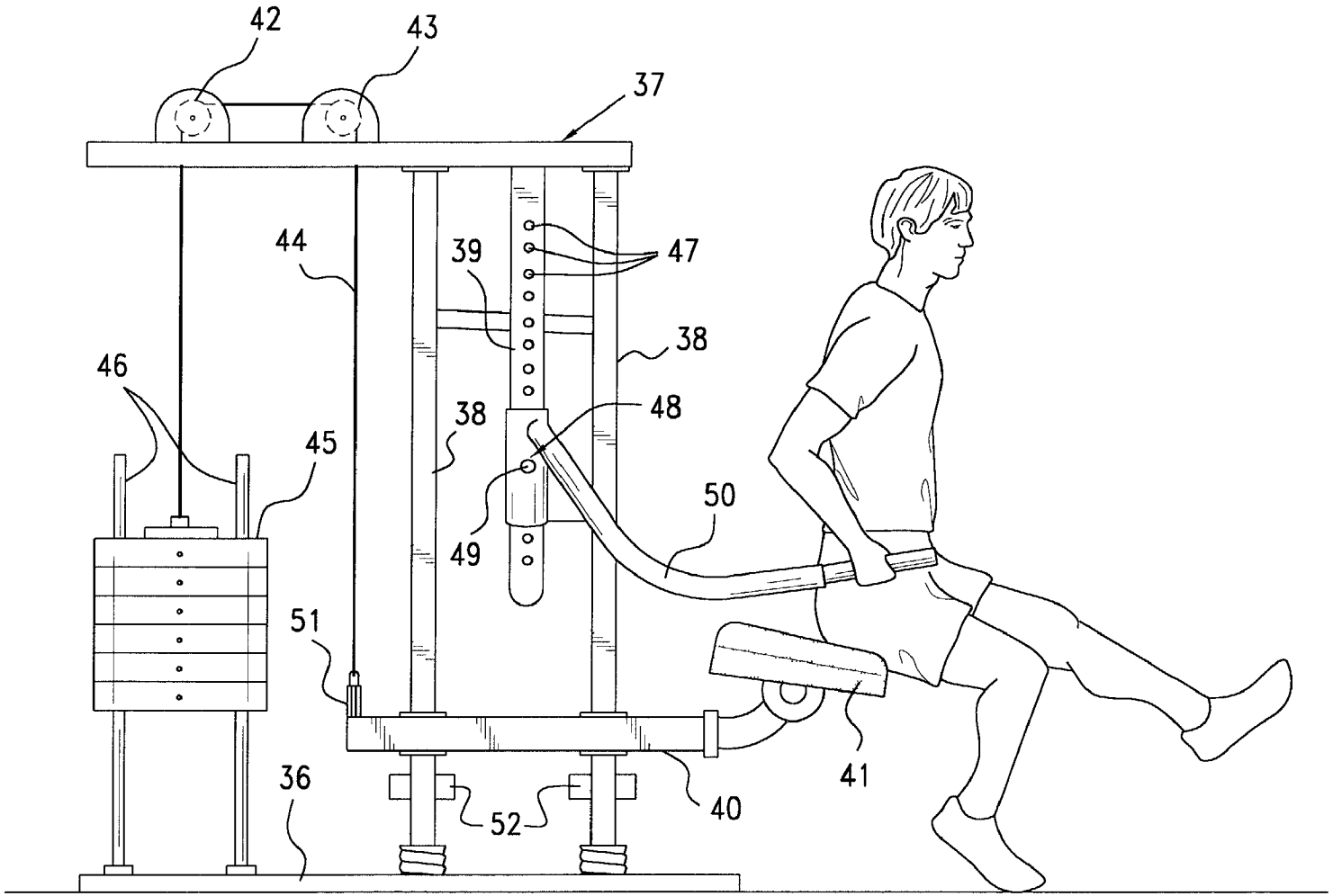
FIG. 5 is an apparatus for exercising the quadriceps muscles with a body weight offsetting seat that slides up and down on vertical rods.

FIG. 5 is an exercise apparatus for the front thigh muscles, the quadriceps (or quads), and comprises a stand alone support base 36 with a sliding pivotable seat and cable attached to a weight stack. The support base 36 has an upper horizontal and raised framework 37 supported on two cylindrical vertical bars 38. Descending from the upper framework 37 is a vertical plate 39 positioned between the vertical bars and attached to each vertical bar. A horizontal support 40 with circular holes is slidably mounted on the two cylindrical bars 38 with a pivotable padded seat 41 extending away from the base. The upper framework 37 on the vertical bars 38 has a cantilevered portion containing two pulleys 42 and 43 with a cable 44 attached to the top of a selectorized weight stack 45 on guide rods 46. Vertical plate 39 contains holes 47 and a surrounding slide 48 with a single hole with a pin 49 in the hole positioning the slide with respect to one of the vertical plate holes. The slide has a bar 50 on each side extending to an area adjacent and above the padded seat 41. The horizontal support 40 has an attachment point 51 directly below pulley 43 with the cable 44 attached thereto.

The user positions a stopper 52 on the vertical bar 38 so that the user does not go below a point at which the thighs are parallel to the floor. With the weight selected on the weight stack 45, the user backs up between and grasps the bars 50 with his buttocks contacting padded seat 41 with the legs fully extended. From this position, the user can slowly squat to the horizontal position, pause, and return to the legs fully extended position. This squat exercise can be performed with one or two legs, depending on the amount of weight selected on weight stack 45 to assist and offset the user's body weight.

The four apparatuses described above are very beneficial in rehabilitating and developing the hamstring and quad muscles of the legs of users who have not developed their muscles to a great degree. The biceps femoris muscle is exercised in a novel way by reversing the locations of the "origin" and "insertion" of the biceps femoris muscle that is not available in currently known machines.

Figure 6A:
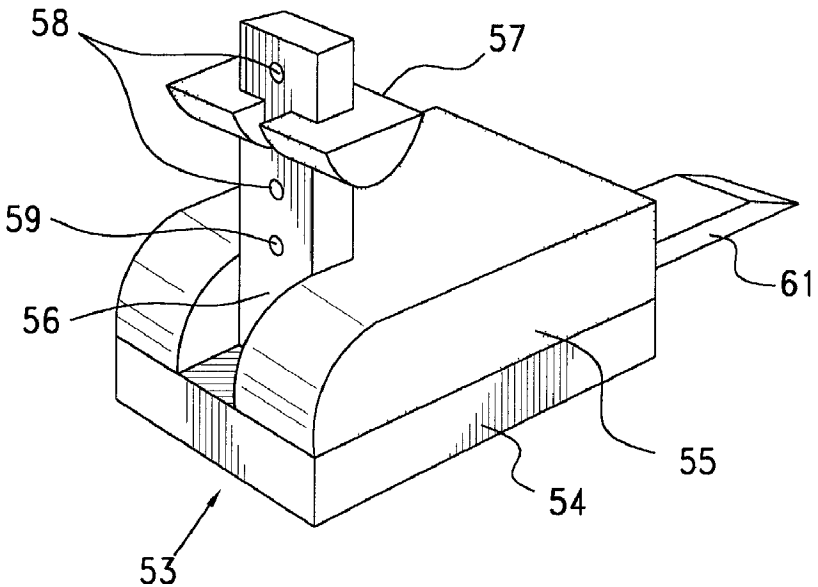
FIGS. 6*a* and 6*b* show a stand alone apparatus which can be used with weights.
Figure 6B:
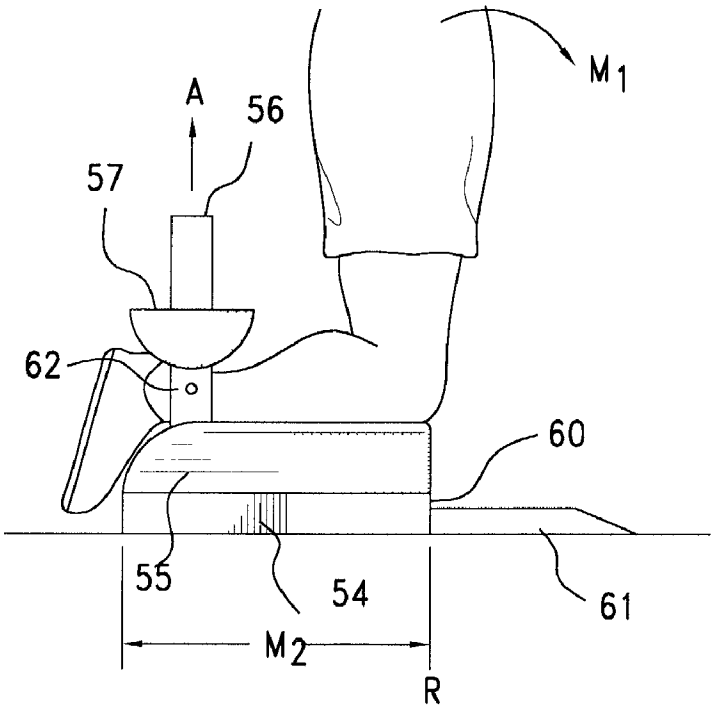

FIGS. 6*a* and 6*b* illustrate a stand alone apparatus 53 intended to be used without weights.

The stand alone apparatus has a base structure 54 to which a pad 55 is attached by any conventional manner. At one end of the base structure 54 there extends a post 56 to which a slidable cushion 57 is mounted. The post 56 includes a plurality of spaced holes 58 for accommodating a pin 59 inserted therein for use in retaining the cushion 57 fixed onto the post 56. For this purpose a pin 59 would be inserted in the hole above and below the cushion 57. At its front end the base structure 55 has an opening 60 in which a balance beam 61 is slidable relative to the base structure 54.

In use, an individual kneels as shown in FIG. 6*b* on the pad 55 with their ankles 62 engaging the cushion 57. The balance beam 61 has been withdrawn from the base structure 54 a sufficient extent to produce the reaction force R. The reaction force R differs depending on its extension from the base structure 54. The individual so position extends forwardly in the direction $M_1$. This movement creates the action force A due to the engagement of the ankles 62 with the cushion 57, and also the reaction force R due to the engagement of the balance beam 61 with the floor. The forces A-R created a moment which counter-acts the moment created by the individuals body weight as the upper body moves in the direction $M_1$.

The individual can then reverse their movement and repeat it to exercise the biceps femoris muscles. No weights other than body weight is necessary.

Figure 7:
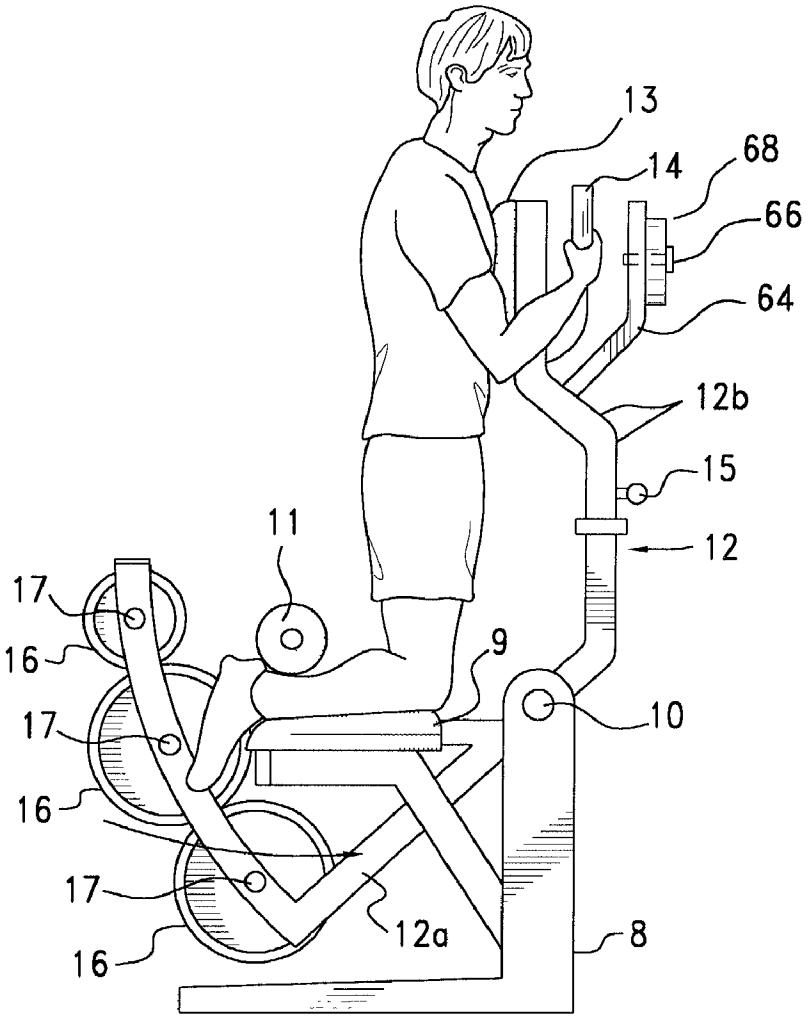
FIG. 7 is a variant of the apparatus shown in FIG. 2.

FIG. 7 shows a variant of the apparatus shown in FIG. 2. The variant resides in the addition of a bar 64 attached to the upper 12*b* of the lever 12. The bare 64 is adapted to receive a pin 66 to hold a plate weight 68. The addition of the plate weight 68 provides the user with the option of adding an additional restraint in the return movement of the exercise.

In each embodiment, the pad (9, 55) can be adjusted longitudinally to accommodate the different leg sizes of the users.

What is claimed is:

1. Workout equipment for exercising the leg muscles of a user of the equipment, comprising:

a support base, having spaced apart upstanding legs, each with a free end and together defining a pivot axis at their free ends;

a lever pivotably connected to said support base at said pivot axis;

said lever having a center beam situated generally between said spaced apart upstanding legs to extend in a generally vertical direction above said support base, a pair of extension beams which extend from said center beam and engage said spaced apart upstanding legs at said pivot axis, weight support means connected at one end to one of said extension beams, and body engaging means connected to said center beam;

a knee pad mounted to said support base; and ankle engaging means, wherein:

said support base includes means for mounting said ankle engaging means adjacent said knee pad, and above said knee pad such that said ankle engaging means engages the rear side of the ankles of the user of the equipment.

2. The workout equipment as defined in claim 1, wherein:

said lever includes an adjustable upper portion of said center beam which includes said body engaging means.

3. The workout equipment as defined in claim 2, further comprising:

fastening means connected to said center beam for the adjustment of said upper portion of said center beam.

4. The workout equipment as defined in claim 1, wherein:

said body engaging means includes a chest engaging pad and a pair of handles to be grasped by the user's hands.

5. The workout equipment as defined in claim 1, wherein:

said weight support means is situated laterally adjacent to said knee pad and said ankle engaging means.

* * * * *